US005120934A

United States Patent [19]

Nakada et al.

[11] Patent Number: 5,120,934

[45] Date of Patent: Jun. 9, 1992

[54] CORDLESS ELECTRIC IRON AND STAND ASSEMBLY WITH TIMED AUDIBLE REHEAT ALARM

[75] Inventors: Seiichi Nakada, Amagasaki; Takahisa Tsuji, Osaka; Toyohiko Yagi, Takatsuki; Masao Shimizu, Nishimomiya; Yoshinori Kataoka, Osaka, all of Japan

[73] Assignee: Matsushita Electric Industrial Co., Ltd., Osaka, Japan

[21] Appl. No.: 253,212

[22] Filed: Oct. 4, 1988

[30] Foreign Application Priority Data

| | | | |
|---|---|---|---|
| Oct. 6, 1987 | [JP] | Japan | 62-252131 |
| Oct. 6, 1987 | [JP] | Japan | 62-252132 |
| Oct. 6, 1987 | [JP] | Japan | 62-252133 |
| Oct. 16, 1987 | [JP] | Japan | 62-262086 |

[51] Int. Cl.[5] ..... H05B 1/02; D06F 75/14; D06F 75/40; D06F 79/02

[52] U.S. Cl. ..... 219/247; 38/75; 38/77.8; 38/82; 38/142; 219/242; 219/251; 219/259; 219/506

[58] Field of Search ..... 219/245-259, 219/242, 506; 38/82, 77.8, 142, 75

[56] References Cited

U.S. PATENT DOCUMENTS

| | | | |
|---|---|---|---|
| 2,714,650 | 8/1955 | Werner . | |
| 2,714,659 | 8/1955 | Werner . | |
| 2,820,877 | 1/1958 | Oates, Jr. . | |
| 3,398,260 | 8/1968 | Martens . | |
| 3,745,676 | 7/1973 | Dikoff . | |
| 3,760,149 | 9/1973 | Harsanyl . | |
| 4,650,268 | 3/1987 | Dobson et al. . | |
| 4,827,104 | 5/1989 | Foster | 219/251 |

FOREIGN PATENT DOCUMENTS

| | | | |
|---|---|---|---|
| 0225297 | 6/1987 | European Pat. Off. . | |
| 0225298 | 6/1987 | European Pat. Off. . | |
| 59-23597 | 12/1984 | Japan | 219/247 |
| 60-68900 | 4/1985 | Japan | 219/247 |
| 60-106500 | 6/1985 | Japan | 219/247 |
| 60-129100 | 7/1985 | Japan | 219/247 |
| 61-16792 | 1/1986 | Japan | 38/77.8 |
| 63-59999 | 3/1988 | Japan | 219/247 |
| 63-132700 | 6/1988 | Japan | 219/247 |
| 63-206300 | 8/1988 | Japan | 219/247 |
| 609174 | 9/1948 | United Kingdom . | |

*Primary Examiner*—Anthony Bartis
*Attorney, Agent, or Firm*—Wenderoth, Lind & Ponack

[57] ABSTRACT

A cordless electric iron assembly has an iron removably mounted on a power supply stand adapted to be connected to a power supply. Separable mating electric terminals interposed between the iron and stand establish an electrical connection between the electric heater in the iron and the stand so long as the iron is placed on the stand. A detector on the stand detects the presence or absence of the iron on the stand and is used to activate an adjustable counter in response to removal of the iron from the stand. The counter activates an audible alarm after the elapse of a predetermined time period during which the iron is removed from the stand and in use to signal that the iron should be returned to the stand for reheating. A carrying case is detachable from the stand and accommodates the iron positioned on the stand with the mating terminals connected for storage of the iron during non-use.

9 Claims, 6 Drawing Sheets

CORDLESS ELECTRIC IRON AND STAND ASSEMBLY WITH TIMED AUDIBLE REHEAT ALARM

BACKGROUND OF THE INVENTION

1. Field of the Invention

The present invention generally relates to an electric iron and, more particularly, to a cordless iron and a stand designed to support the iron when the iron is not in use for actual ironing and to conduct heating current to the iron while the iron is placed on the stand.

2. Description of the Prior Art

Cordless irons are not a recent development and are disclosed in numerous patent literature items. For example, U.S. Pat. No. 2,714,650, issued Aug. 2, 1955, discloses an iron system comprising a stand adapted to be placed on a ironing table and including an iron receiving platform and a housing structure at one end of the platform, and an electric iron adapted to be removably mounted on the platform including a heating soleplate and a handle mounted on the soleplate. An electric power supply means is interposed between the iron and the housing structure fast or integral with the platform and comprises a pair of plungers collapsibly supported by the housing structure for movement between retracted and projected positions, and corresponding connector elements carried by the iron and electrically connected with a heating element in the iron.

The plungers are normally biased by corresponding springs to the projected position, but can be moved to the retracted position against the springs when the iron is placed on the stand with the connector elements held in contact with the associated plungers. Movement of the plunger to the retracted position results in the closure of an electric power supply switch encased within the housing to permit the supply of an electric power to the heating element through the plungers and then through the connector elements. In order to ensure a firm electric connection between the plungers and the connector elements, the platform has a toe clip at the other end thereof opposite to the housing structure for engagement with a bow or nose of the iron.

The iron system disclosed in this U.S. patent is a horizontal support model in that the platform is adapted to be placed on the ironing table and is then clamped thereto.

U.S. Pat. No. 2,820,877, issued Jan. 21, 1958, discloses an iron system comprising a stand including a horizontal base and an inclined iron receiving platform and a housing structure at one end of the base, and an electric iron adapted to be removably mounted on the platform including a heating soleplate and a handle mounted on the soleplate. The electric power supply means used therein comprises a double-pole push button, a contact carrier collapsibly supported in the housing structure for movement between retracted and projected positions, and corresponding connector elements carried by the iron at the stern thereof and electrically connected with a heating element in the iron.

The double-pole push button is supported beneath the platform and has a push button adapted to be depressed in response to the placement of the iron on the platform thereby to complete an electric circuit for energizing the heating element.

The iron system disclosed in this U.S. patent is an inclined support model in that the platform is so inclined that, when the iron is placed on the platform, the iron can slide rearwardly by the effect of a gravitational force to establish the electric connection between the contact carrier and the connector elements.

U.S. Pat. No. 3,398,260, issued Aug. 20, 1968, discloses an iron system of the upright support type comprising a stand comprising a plurality of concentric annular sockets delimited by a corresponding number of concentric annular walls and a pair of contact elements exposed to the sockets. The iron has a stern portion formed with concentric annular plugs which are, when the iron is placed on the stand in upright fashion, adapted to be slid into the associated sockets and held in electric contact with the contact elements.

U.S. Pat. No. 3,760,149, issued Sep. 18, 1973, discloses both a horizontal support model and an upright support model of an iron system. In the case of the horizontal support model, connector elements forming parts of the electric power supply means and connected to the heating element in the iron are carried by the soleplate and exposed to the outside through the soleplate, and connector elements forming parts of the electric power supply means and connected to the electric power source are embedded in the platform. A safety switch is employed between the connector elements in the platform and the electric power source in the form of a reed switch adapted to be operated by a magnet carried by the handle of the iron.

In the case of the upright support model, an electric power supply system generally similar to that disclosed in U.S. Pat. No. 2,820,877 is employed.

U.S. Pat. No. 4,650,268, issued Mar. 17, 1987, discloses an iron system of the upright support type wherein, while as the electric power supply means at least one pair of plug pins carried by the iron and a correspondingly one pair of socket receptacles mounted on the stand are employed, a movable baffle is employed to close access openings leading to the socket receptacles that are electrically connected to a power source, thereby to reduce the risk of electrical shock. The baffle can be moved to open the openings in response to the placement of the iron on the stand and, for this purpose, this U.S. patent employs an actuating projection similar to the plug pins and an arm integral or fast with the baffle that is engageable with the actuating projection.

All of these prior art patents are directed to the improvement in electric connection between the iron and the stand. Although the electric connection employed in the prior art iron systems may be satisfactory, they all have the following problems.

When it comes to the cordless iron system, the iron when in use for actual ironing is removed from the stand. As a matter of fact, this means that the supply of electric power to the heating element embedded in the iron is interrupted. Therefore, with increase of the ironing time during which the ironing is performed with the iron removed from the stand, the temperature of the soleplate which has been heated by the heating element decreases progressively and, therefore, the ironing effect to iron out wrinkles in a cloth is reduced. In order to keep the temperature of the soleplate within a tolerance, the iron has to be frequently placed on the stand so that the electric power can be supplied to the heating element. This often brings about reduction in efficiency of the ironing job.

Where the iron has a steaming capability and, therefore, has a reservoir and a pattern of steam nozzles opening from the soleplate, it is known that water in the reservoir is supplied to a vaporizing chamber in which the water is heated to vaporize. Accordingly, when steaming is performed while the iron is removed from the stand with the supply of the electric power to the iron interrupted, the soleplate tends to be cooled by the effect of the latent heat of vaporization. Accordingly, it often occurs that, if one continues ironing without knowing that the temperature has decreased to a value at which the steam is no longer available, water drops escape from the steam nozzles and moisten the clothing being ironed.

A further problem inherent in the prior art cordless iron systems is that, if one leaves the site of ironing with the iron placed on the stand for a substantial length of time, the iron will be excessively heated, enhancing the risk of a fire.

A still further problem inherent in the prior art cordless iron systems is that, since the temperature of the soleplate may be high when the ironing has been finished, one has to wait for a substantial length of time before the soleplate cools down so that the iron and the stand can be put away. During the length of time in which the iron is left on the stand for cooling with the electric system in the stand disconnected from the electric power source, but the temperature is still high, there may be a possibility that a small child may touch the iron and suffer from a burn.

SUMMARY OF THE INVENTION

Accordingly, the present invention has been devised with a view to substantially eliminating the above discussed problems inherent in the prior art cordless iron assemblies and has for its essential object to provide an improved cordless iron assembly wherein means is provided for warning the user of the iron assembly that the temperature of the soleplate is decreased to a value lower than the tolerance, thereby to invite the user to place the iron on the stand.

According to the present invention, the provision of the warning means makes it possible to avoid the user continuing to iron even when the temperature of the soleplate has decreased to a value lower than the tolerance and also to avoid the possibility of the iron being unnecessarily placed on the stand during the ironing.

The warning means may comprise a detecting means for detecting the temperature of the soleplate and a signaling element which may be a warning lamp or a warning sound generator.

Another important object of the present invention is to provide an improved cordless iron assembly wherein, in the event that during steaming the temperature of the soleplate has decreased to a value lower than a predetermined value, a water passage built in the iron is automatically closed by a built-in valve unit to avoid the possibility of water drops escaping from the steam nozzle, and wherein means is provided for informing the user of the iron assembly of the necessity for the iron to be placed on the stand when or shortly before the valve unit is operated in response to the decrease of the temperature of the soleplate below the predetermined value.

A further important object of the present invention is to provide an improved cordless iron assembly wherein means is provided for detecting the placement of the iron on the stand so that, when the iron is left placed on the stand for a substantial length of time longer than a predetermined time, the supply of electric power from the power source to the iron by way of the stand can be automatically interrupted, thereby to avoid any possible excessive heating of the iron and also to minimize the risk of a fire.

A still further important object of the present invention is to provide an improved cordless iron assembly wherein a carrying case is provided, with its bottom constituted by the stand, for enclosing the iron placed on the stand for the purpose of safety and also for the purpose of convenience of transportation. According to the present invention, the iron on the stand may be encased by the carrying case immediately after the ironing has been finished, thereby avoiding the access to the iron which is still high in temperature thereby to minimize the risk of a burn or thereby to facilitate a ready transportation of the cordless iron assembly from place to place.

BRIEF DESCRIPTION OF THE DRAWINGS

These and other objects and features of the present invention will become clear from the following description of a preferred embodiment thereof with reference to the accompanying drawings, in which.

DETAILED DESCRIPTION OF THE EMBODIMENT

Figure 1:
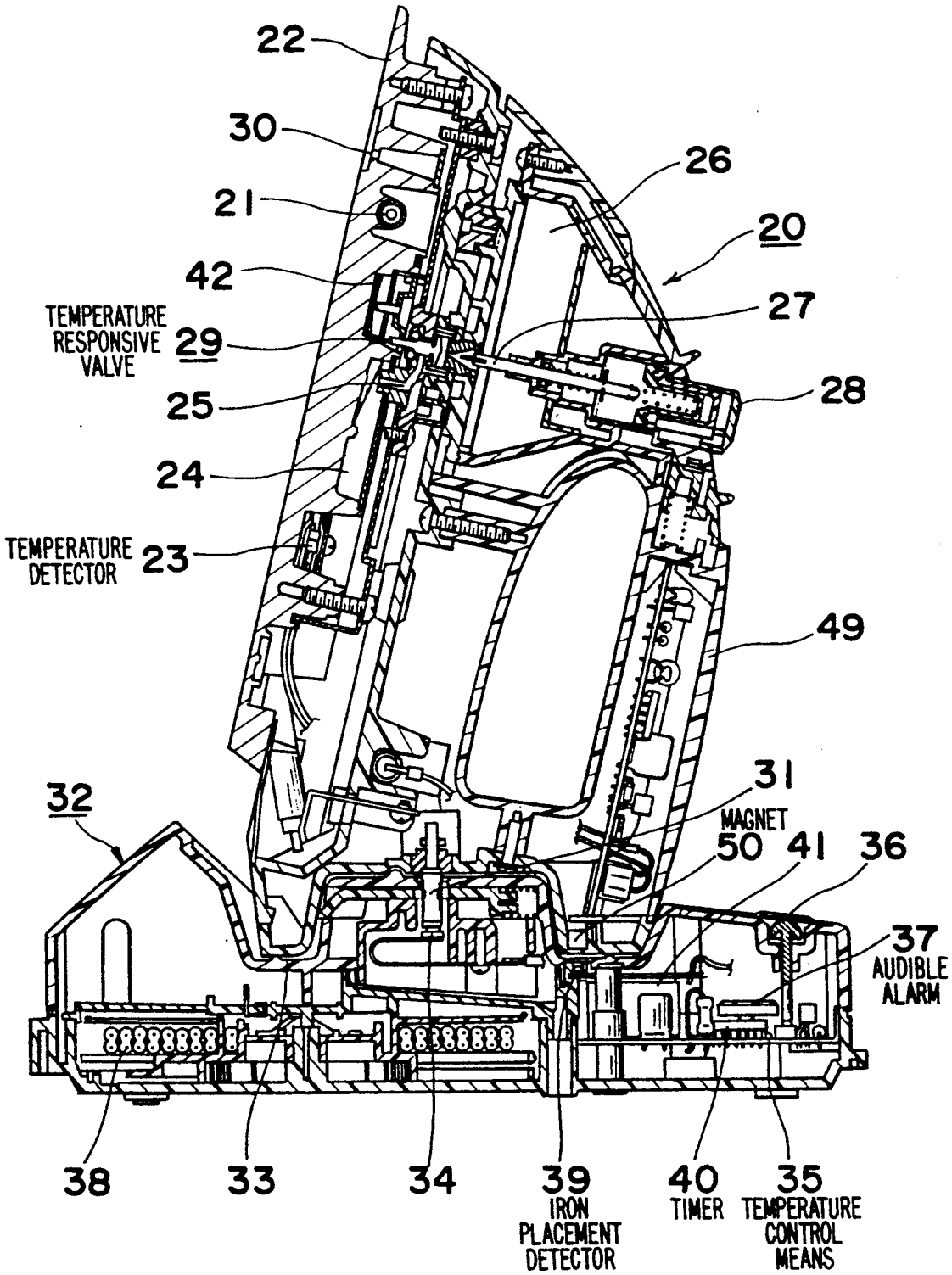
FIG. 1 is a longitudinal sectional view of a cordless iron assembly comprised of an iron and a stand according to a preferred embodiment of the present invention.

Before the description of a preferred embodiment of the present invention proceeds, it is to be noted that like parts are designated by like reference numerals throughout the accompanying drawings.

A cordless iron assembly according to the preferred embodiment of the present invention shown in the accompanying drawings generally compresses an iron 20, a stand 32 and a carrying case 51, it being to be noted that the stand 32 concurrently forms the bottom of the carrying case 51.

Figure 2:
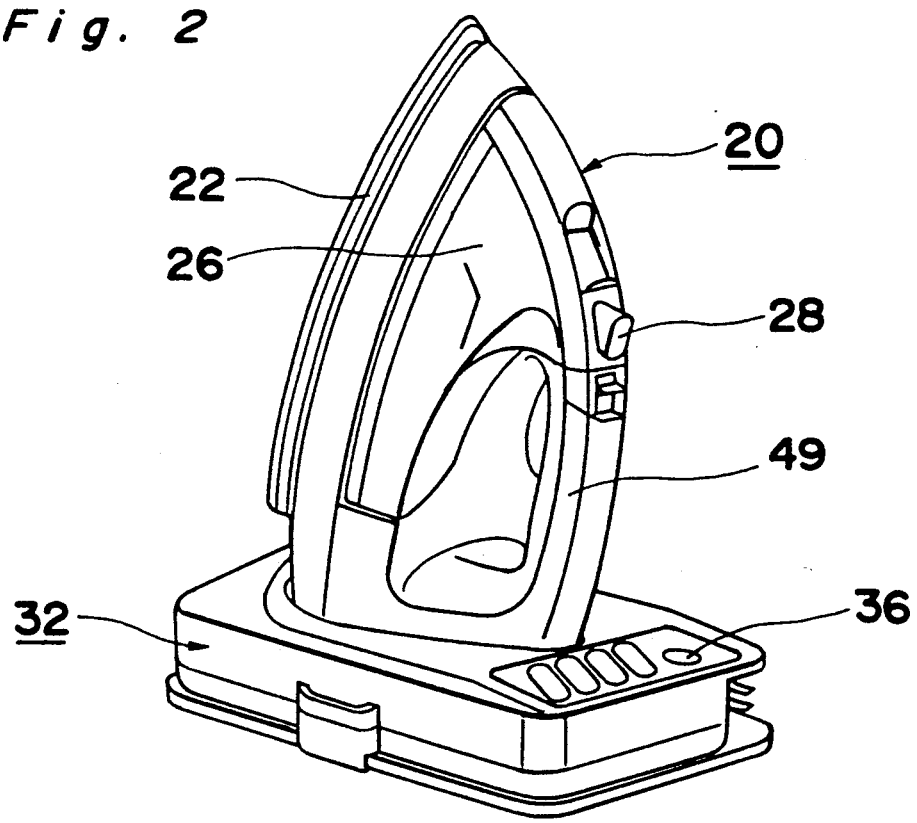
FIG. 2 is a perspective view of the cordless iron assembly shown in FIG. 1.

Referring to the accompany drawings and particularly to FIGS. 1 and 2, the iron 20 comprises a soleplate 22 including a generally planar heater 21 and having steam nozzle openings 30 defined therein in a desired or predetermined pattern for applying steam to a cloth being ironed; a temperature detector 23 such as, for example, a thermistor for directing the temperature of the soleplate 22; a vaporizing chamber 24 defined above the soleplate 22 for vaporizing water thereby to provide the steam; a reservoir 26 communicated with the vaporizing chamber 24 through a water passage 25 for supplying water in the reservoir 26 to the vaporizing chamber 24; an on-off steam valve 27 operatively coupled with a manually operated steam button 28; a temperature responsive valve unit 29 for selectively closing and opening the water passage 25 in dependence on the temperature of the soleplate 22; a plurality of connector terminals 31 wired electrically to the heater 21 and the temperature detector 23; and a handle 49.

The stand 32 is of a type capable of supporting the iron 20 in an upright position with a stern or rear end of the iron 20 resting thereon. This stand 32 comprises a mounting recess 33 so designed and so shaped as to receive therein the steam of the iron 20; corresponding connector terminals 34 which are, when the iron 20 is placed on the stand with the stern thereof received in the mounting recess 33, electrically connected with the associated connector terminals 31 in the iron 20; an electronic temperature control means 35 including a microcomputer and adapted to receive an output signal from the temperature detector 23 in the iron 20 during the placement of the iron 20 on the stand 32 for controlling the temperature of the soleplate 22; a temperature regulator 36 having "High", "Medium;", "Low" and "Off" buttons; a sound generator 37 such as, for example, a buzzer; a retractable power supply cord having one end connected to the connector terminals 34 and the other end adapted to be plugged in a power outlet, a substantially intermediate portion of said cord being wound on a retractor reel housed within the stand 32; a placement detector 38 comprised of, for example, a reed switch for detecting the placement of the iron 20 on the stand 32; a control circuit 40 having a timer function adapted to receive an output signal from the placement detector 39 for controlling the electric power supply to the heater 21 in the iron 20; and a switching means 41 for controlling the supply of an electric power to the heater 21.

Figure 3:
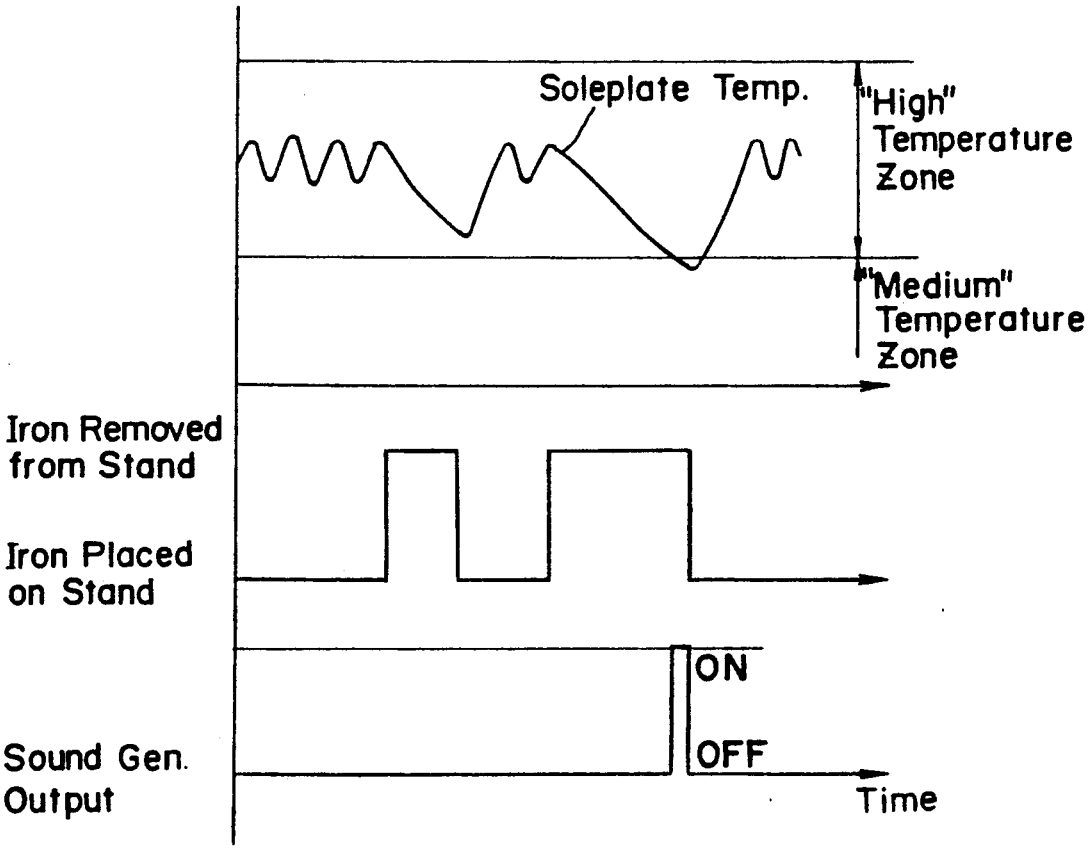
FIG. 3 is a timing chart showing the relationship between a change in temperature of an iron soleplate and the time at which a warning sound is generated.

The operation of the cordless iron assembly of the above described construction will now be described with particular reference to FIGS. 1 and 3.

Assuming the "High" button of the temperature regulator 36 is depressed signifying that the heater 21 should heat the soleplate 22 to a relatively high temperature, and assuming also that the soleplate 22 is heated to the relatively high temperature, set by the "High" button of the temperature regulator 36, in a manner controlled by the temperature control means 35, the temperature of the soleplate 22 decreases progressively with increase of the time during which the iron 20 is in use for ironing and is therefore removed from the stand 32. However, when the iron 20 is placed on the stand 32 with the steam thereof received in the mounting recess 33, the supply of the electric power from the power source to the heater 21 through the electric system in the stand 32 is resumed accompanied by the consequent increase of the temperature of the soleplate 22.

When the iron 20 is again removed from the stand 32 for actual ironing, the temperature of the soleplate 22 eventually decreases to a value lower than a high temperature zone assigned to the "High" button of the temperature regulator 36 and falling within a medium temperature zone assigned to the "Medium" button of the temperature regulator 36. As soon as the temperature of the soleplate 22 desired to be kept in the high temperature zone falls within the medium temperature zone, the sound generator 37 is activated to generate a warning sound thereby to inform the user of the excessive decrease of the temperature of the soleplate 22, inviting the user to place the iron 20 on the stand 32 for reheating the soleplate 22.

In practice, since no output signal from the temperature detector 23 built in the iron 20 is relayed to the temperature control means 35 when and so long as the iron 20 is removed from the stand for actual ironing, the microcomputer employed in the temperature control means 35 is so programmed as to activate the sound generator 37 at a predetermined time T1 subsequent to the removal of the iron 20 from the stand 32, which predetermined time T1 can be calculated in consideration of the speed of decrease of the temperature of the soleplate 22, memorized by the temperature control means 35, from the temperature which the soleplate 22 attains shortly before the removal of the iron 20 from the stand 32. However, this predetermined time T1 is a function of the temperature attained by the soleplate 22 shortly before the removal of the iron 20 from the stand 32, which temperature is variable depending on which one of the "High", "Medium" and "Low" buttons of the temperature regulator 36 has been depressed.

More specifically, where the iron 20 is removed from the stand 32 for ironing while the temperature of the soleplate 22 is high, the predetermined time T1 which is required to pass before the sound generator 37 is actually activated is relatively long. However, this predetermined time T1 decreases progressively with decrease of the temperature of the soleplate 22 that occurs subsequent to the removal of the iron 20 from the stand 32.

Thus, it will readily be understood that, after the passage of the predetermined time T1 determined in consideration of the speed of decrease of the temperature of the soleplate 22, the temperature control means 35 can trigger the sound generator 37 to emit a series of sounds warning the user of the excessive decrease of the temperature of the soleplate 22 while inviting the user to place the iron 20 on the stand 32 for reheating, even though the iron 20 and the stand 32 are separated from each other. Therefore, it is possible to avoid the user continuing to iron even when the temperature of the soleplate has decreased to a value lower than the tolerance and also to avoid the possibility of the iron being unnecessarily placed on the stand during the ironing.

The details and the operation of the temperature responsive valve unit 29 built in the iron 20 for selectively closing and opening the water passage 25 in dependence on the temperature of the soleplate 22 detected by the temperature detector 23 will now be described with particular reference to FIGS. 4 and 5.

Figure 4:
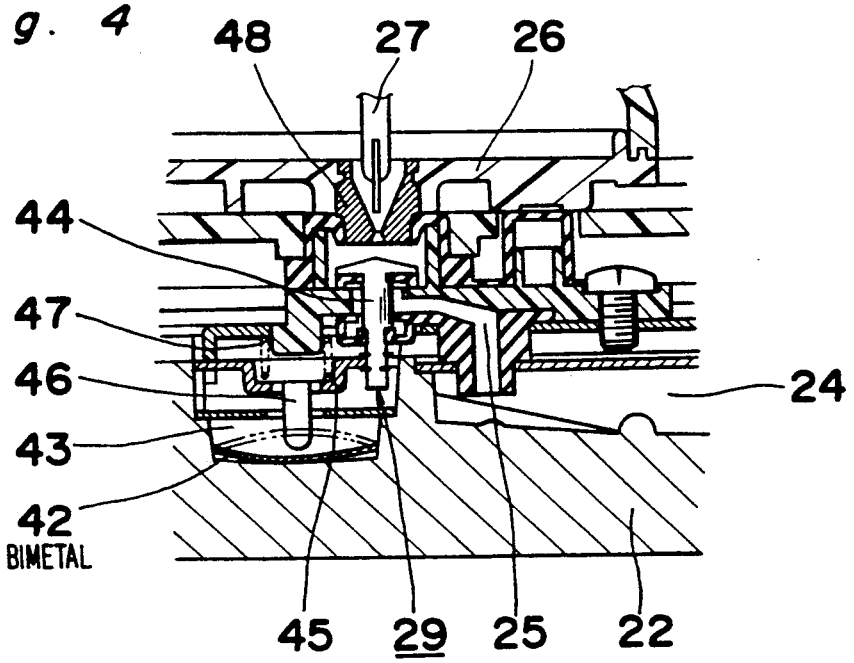
FIG. 4 is a sectional view, on an enlarged scale, of a valve unit built in the cordless iron.

The temperature responsive valve unit 29 comprises a temperature responsive member 42 which may be a bimetal and which can be buckled to one of first and second positions, said temperature responsive member 42 normally assuming the first position when cool or not sufficiently heated as shown by the solid lines in FIG. 4. This temperature responsive member 42 is accommodated within a recess 43 defined in the soleplate 22. The temperature responsive valve unit 29 also comprises a movable plate 45 positioned immediately above the temperature responsive member 42 and having a valving spindle 44 secured thereto so as to permit the valving spindle 44 to extend generally perpendicular to the soleplate 22. The movable plate 45 and, hence, the valving spindle 44 are normally biased downwards as viewed in FIG. 4 by a biasing spring 47, with the valving spindle 44 closing the water passage 25. The movable plate 45 has a tongue 46 bent therefrom so as to extend downwards towards the temperature responsive member 42 and to terminate in contact with, or spaced a slight distance from, the temperature responsive member 42 in the first position.

Reference numeral 48 designates a nozzle provided at the bottom of the reservoir 26 and which is so designed and so sized as to permit a controlled amount of water in the reservoir 26 to be supplied towards the vaporizing chamber 24 through the water passage 25. The nozzle 48 is adapted to be selectively closed or opened in response to the movement of a valve rod 27 integral or fast with the steam button 27 from a upwardly shifted position towards a downwardly shifted position and from the downwardly shifted position towards the upwardly shifted position, respectively, regardless of the position of the valving spindle 44. It is, however, to be noted that, as is well known to those skilled in the art, the steam button 28 is manipulated, only when steaming is desired, to move the valve rod 27 to the depressed position to close the nozzle 48, thereby interrupting the flow of water from the reservoir 26 to the vaporizing chamber 24.

Assuming that the soleplate 22 has been sufficiently heated and the iron 20 is subsequently removed from the stand for actual ironing, the steam button 28 is to be released when steaming is also desired during the actual ironing. When consequently upon the release of the steam button 28 the valve rod 27 is moved from the downwardly shifted position to the upwardly shifted position, the nozzle 48 is opened to allow the supply of the controlled amount of water from the reservoir 26 towards the vaporizing camber 24 via the water passage 25. At this time, if the temperature of the soleplate 22 being heated is still lower than a first transformation temperature at which the temperature responsive member 42 undergoes the buckling motion from the first position as shown by the solid lines in FIG. 4 towards the second position as shown by the phantom line in FIG. 4, the temperature responsive valve unit 29 is in position to close the water passage 25 and, therefore, the controlled amount of water having passed through the nozzle 48 will not be supplied to the vaporizing chamber 24.

Only when and after the soleplate 22 has been heated to a temperature equal to or higher than the first transformation, temperature of the temperature responsive member 42, will the temperature responsive member 42 undergo the buckling motion from the first position towards the second position, thereby lifting the tongue 46 and, hence, the movable plate 45 upwardly against the spring 47, accompanied by a correspondingly upward shift of the valving spindle 44. As a result of the upward shift of the valving spindle 44 which has taken place in the manner described above, the water passage 25 is opened to allow the controlled amount of water to flow through the water passage 25 towards the vaporizing chamber 24. The water entering the vaporizing chamber 24 is vaporized to provide steam which is in turn jetted outwardly of the iron 20 through the steaming nozzles 30.

As the steaming continues while ironing, the latent heat of vaporization is absorbed by the soleplate 22 accompanied by a consequent decrease of the temperature of the soleplate 22. Should the temperature of the soleplate then decreasing with time attain a value equal to or lower than a second transformation temperature at which the temperature responsive member 42 undergoes the reverse buckling motion from the second position towards the first position, that is, a predetermined temperature at which the steam is no longer produced, or should a predetermined length T2 of time shorter than the length T1 of time required for the soleplate temperature to be decreased be passed, the temperature control means 35 drives the sound generator 37 to generate a warning sound.

In practice, however, since no output signal from the temperature detector 23 built in the iron 20 is relayed to the temperature control means 35 when and so long as the iron 20 is removed from the stand 32 for actual ironing, the microcomputer employed in the temperature control means 35 is so programmed as to activate the sound generator 37 at a predetermined time T2 subsequent to the removal of the iron 20 from the stand 32, which predetermined time T2 can be calculated in consideration of the speed of lowering of the temperature of the soleplate 22, memorized by the temperature control means 35, down from the temperature which the soleplate 22 attains shortly before the removal of the iron 20 from the stand 32.

More specifically, where the iron 20 is removed from the stand 32 for ironing while the temperature of the soleplate 22 is high, the predetermined time T2 which is required to pass before the sound generator 37 is actually activated is relatively long. However, this predetermined time T2 decreases progressively with decrease of the temperature of the soleplate 22 that occurs subsequent to the removal of the iron 20 from the stand 32.

Figure 5:
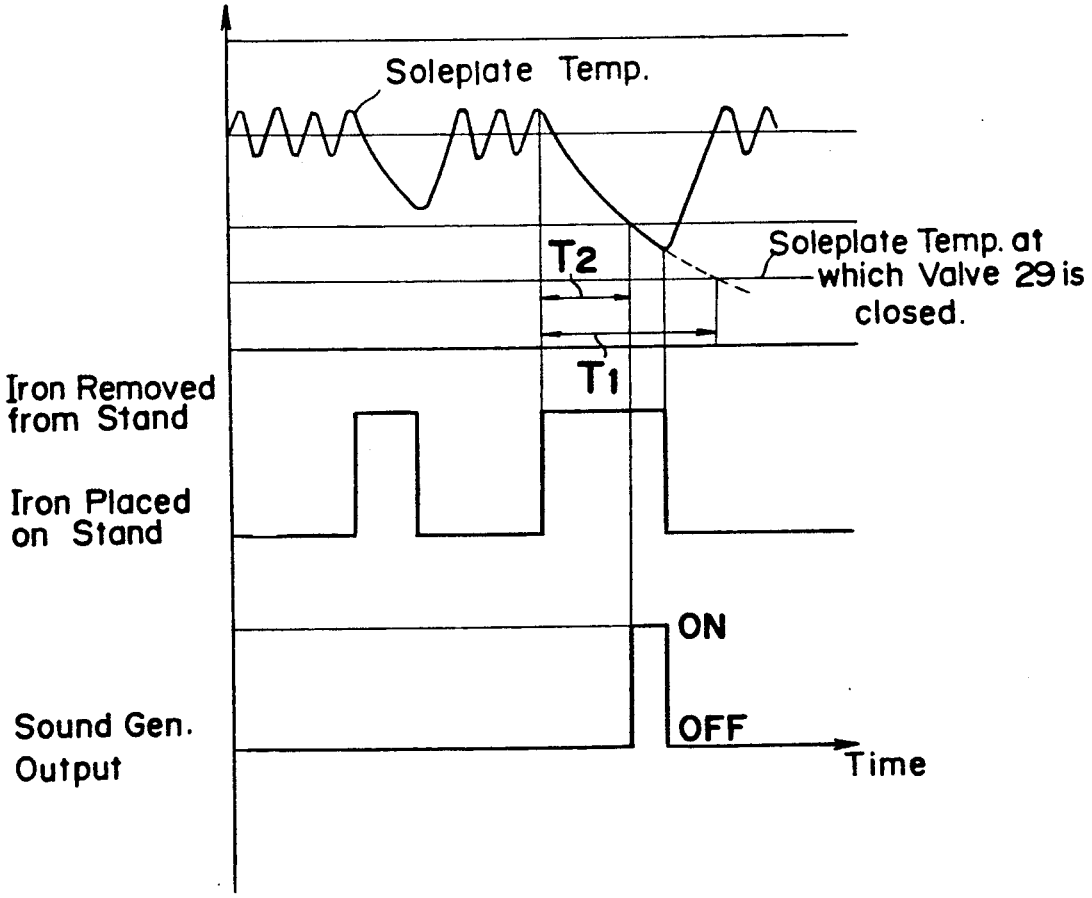
FIG. 5 is a timing chart showing the relationship between the valve unit and a warning sound generator.

Thus, it will readily be understood that, after the passage of the predetermined time T2 determined in consideration of the speed of lowering of the temperature of the soleplate 22 and, hence, when or shortly before the temperature responsive member 42 undergoes the reverse buckling motion from the second position towards the first position with the water passage 25 consequently closed to interrupt the steaming, the temperature control means 35 can trigger the sound generator 37 to generate a series of sounds warning the user of the excessive lowering of the temperature of the soleplate 22 while inviting the user to place the iron 20 on the stand 32 for reheating, even though the iron 20 and the stand 32 are separated from each other.

Where arrangement is made to permit the warning to be made before the water passage 25 is closed as a result of the reverse buckling motion of the temperature responsive member 42 such as shown in the timing chart of FIG. 5, the length of time during which the user has to wait until the soleplate 22 is sufficiently heated to the value equal to or higher than the first transformation temperature of the temperature responsive member 42, that is, the temperature at which the water passage 25 is opened, can be advantageously reduced.

As hereinbefore discussed, to inform the user of the time at which the iron 20 is to be powered on the stand 32 is an important factor for the user to do ironing efficiently. Where steaming is concurrently performed while ironing, the use of the temperature responsive valve unit 29 is effective to avoid any possible escape of water drops from the steam nozzles 30.

Figure 6:
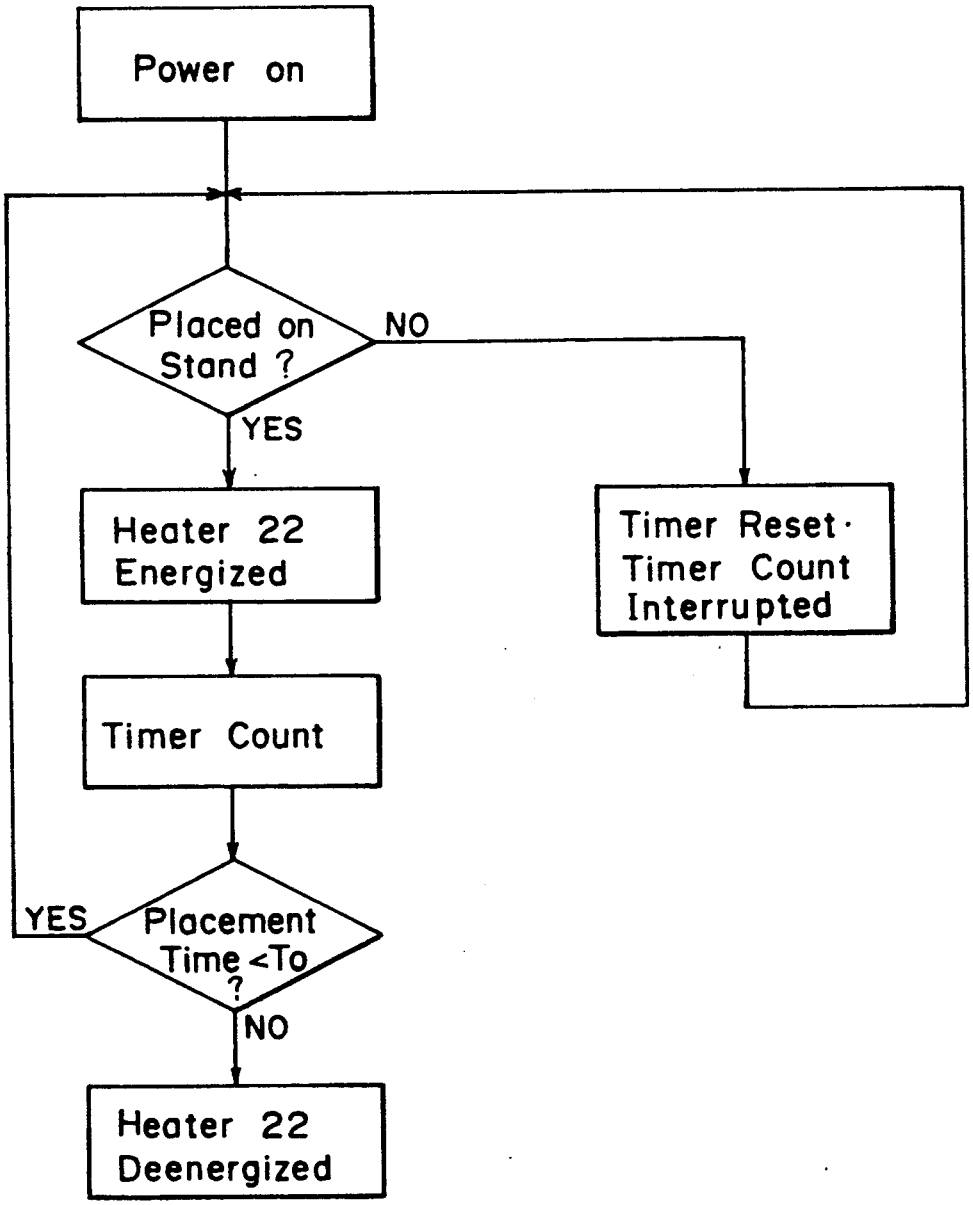
FIG. 6 is a flowchart showing the sequence of operation of a control system used in the cordless iron assembly according to the present invention.

The operation of the iron assembly according to the present invention will no be described with particular reference to FIG. 6 which illustrates the sequence of control performed by the control circuit 40.

Assuming that the power supply cord 38 extending from the stand 32 is connected to an electric power outlet while the iron 20 is placed on the stand with the stern thereof received in the mounting recess 33, the switching means 41 is at this time closed to enable the supply of the electric power to the heater 22 through the power supply terminals 31 then connected with the terminals 34. When and so long as the iron 20 is placed on the stand 32 in the manner described above, a permanent magnet 50 incorporated in the handle 49 of the iron 20 closes the reed switch forming the placement detector 39 provided in the stand 32, causing the placement detector 39 to generate to the control circuit 40 a placement signal indicative of the placement of the iron 20 on the stand 32. Upon receipt of the placement signal, the control circuit 40 starts a counting operation to count the length of time during which the iron 20 is placed on the stand 32.

When and after the temperature of the soleplate 22 subsequently attains the temperature equal to the preset temperature set by the temperature control means 35, the user can remove the iron 20 from the stand 32 for actual ironing without the iron being powered. Simultaneously with the removal of the iron 20 from the stand 32, the control circuit 40, in response to receipt, from the placement detector 39, of a non-placement signal indicative of the iron 20 having been removed from the stand 32, interrupts the counting operation and then resets the timer. Since the temperature of the soleplate 22 decreases as the ironing continues, and when the iron 20 is again placed on the stand 32 for reheating, the supply of the electric power to the heater 22 is resumed and, consequently, the control circuit in response to the placement signal causes the timer, once reset, to perform the counting operation again.

As hereinabove described, during the period in which the supply of the electric power to the heater 22 is taking place while the iron 20 is placed on the stand 32, the counter in the control circuit 40 is operated to count the length of time (i.e., the placement time) during which the iron 20 is placed on the stand 32. If the placement time counted by the counter in the control circuit 40 has not yet exceeded a predetermined time To, the control circuit 40 will not interrupt the supply of the electric power to the heater 22. However, in the event that the placement time exceeds the predetermined time To by reason of, for example, failure to switch off, that is, to set the "Off" button on, the control circuit 40 opens the switching means 41 to interrupt the supply of the electric power to the heater 22.

Thus, it will readily be understood that, even if the user fails to switch the iron off while the iron 20 is placed on the stand 32 with the cord 38 connected to the electric power outlet, the supply of the electric power to the heater 22 will be automatically interrupted upon the passage of a placement time in excess of a predetermined time To, thereby minimizing the risk of a fire.

Hereinafter, the details of the carrying case 51 will now be described with particular reference to FIGS. 7 to 10.

Figure 7:
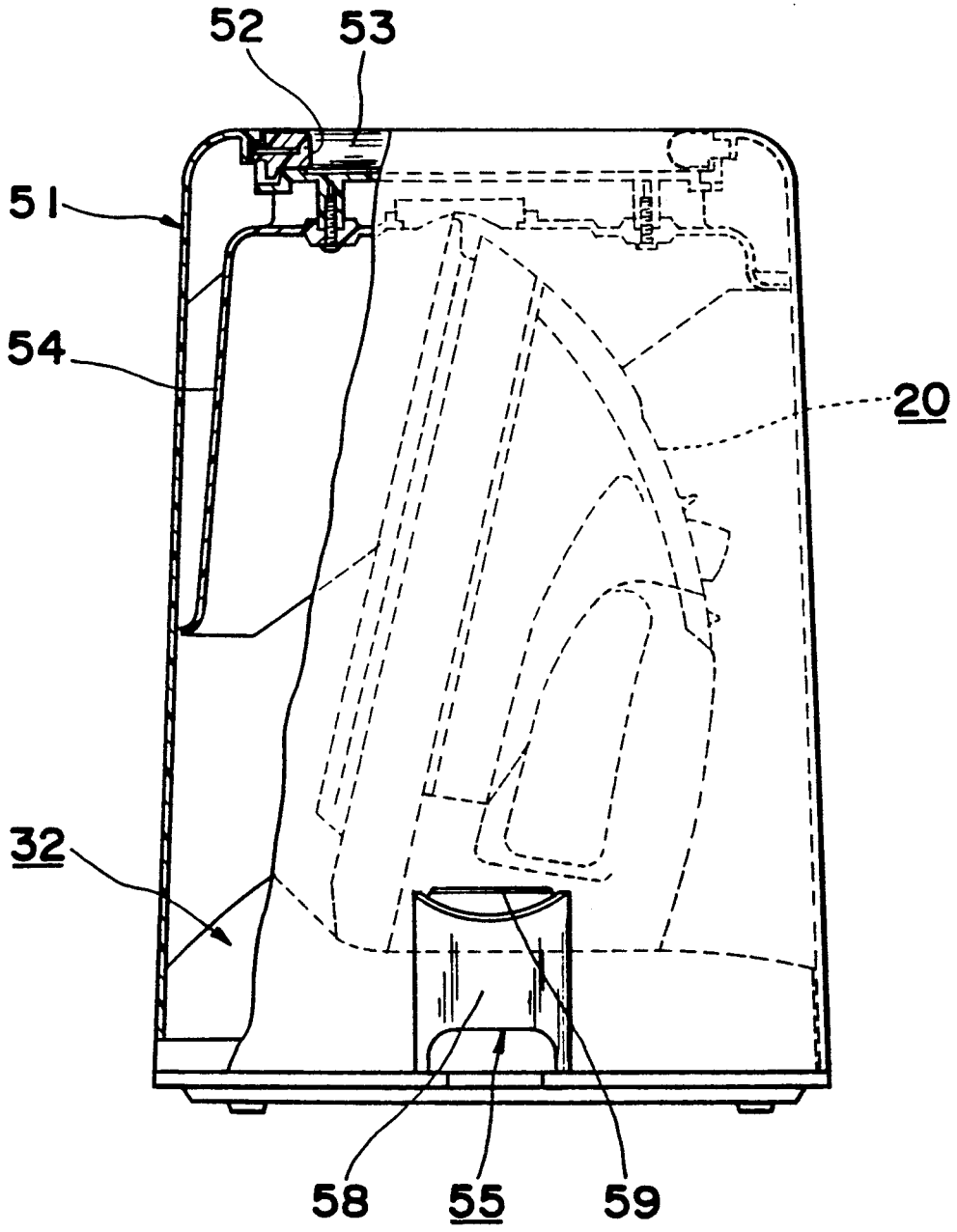
FIG. 7 is a side view, with a portion cut away, of a carrying case enclosing the cordless iron on the stand.
Figure 8:
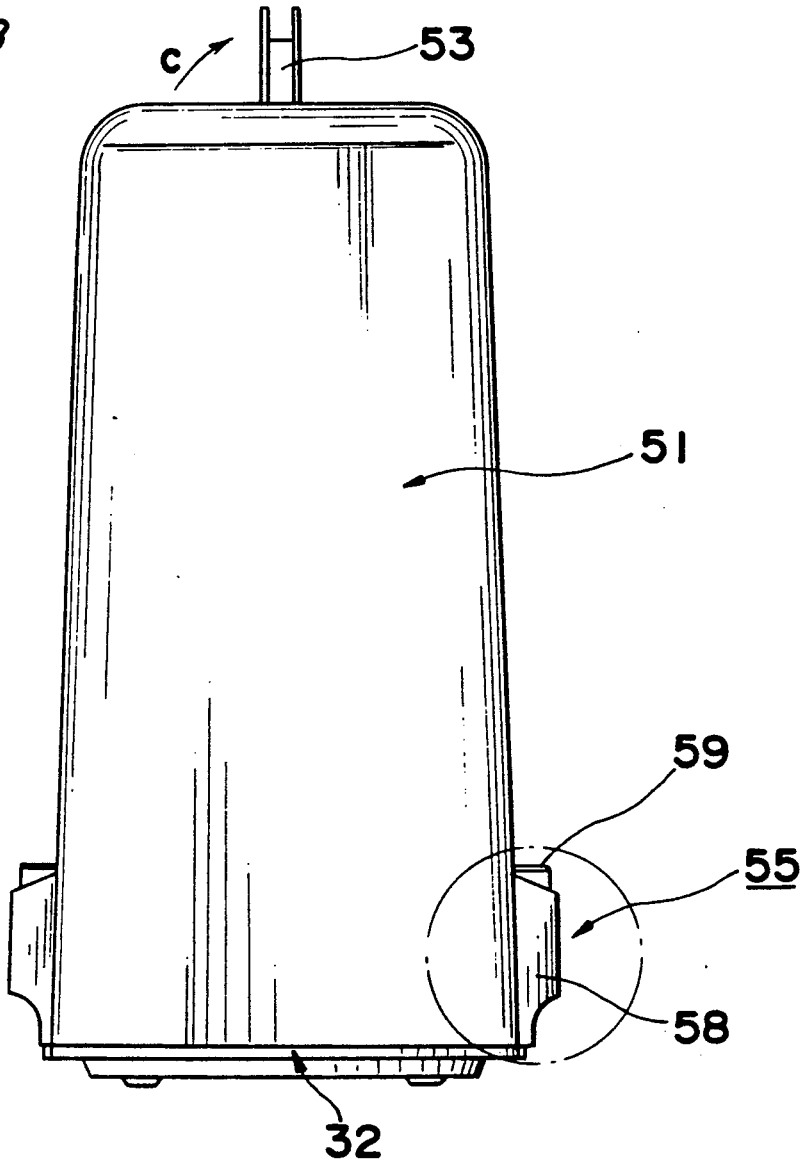
FIG. 8 is a front elevational view of the carrying case shown in FIG. 7.

The carrying case 51 is of a generally cap-like configuration having two pairs of opposite side walls and a top wall and also having a bottom opening in opposition to the top wall, the bottom of said carrying case 51 being constituted by the stand 32 as will become clear from the subsequent description. The top wall of the carrying case 51 is formed with a generally rectangular recess 52 in which a carrying handle 53 is foldably accommodated. The carrying handle is substantially completely housed within the recess 52 when in folded position as shown in FIG. 7, but can protrude outwards and upwardly for the access of the user's hand thereto when in the erected position as shown in FIG. 8.

The interior of the carrying case 51 is lined, or otherwise provided in any suitable manner, with a heat insulating plate 54, made of heat insulating material, to give the carrying case 51 a generally double-walled structure. The heat insulating plate 54 serves not only to avoid a direct contact between the soleplate 22 and the walls of the carrying case 51 during the transportation of the iron assembly from place to place or during the encasement of the iron assembly, but also to retain the iron assembly in position, that is, to avoid any arbitrary motion of the iron 20 within the carrying case 51 during the transportation of the iron assembly.

One of the pairs of the opposite side walls and a corresponding pair of opposite side walls of the stand 32 are provided with clamping means 55 employed one for each side thereof. Each of the clamping means 55 comprises a striker pin 56 secured to, or otherwise formed integrally with, the associated side wall of the stand 32 so as to protrude laterally thereof, and a hook member 57 pivotally connected to the associated side wall of the carrying case 51 and concealed within a lateral covering 58 integral with such associated side wall of the carrying case 51. The hook member 57 so supported is pivotable between a released position and an engaged position about an associated bearing screw **57*a* and is operatively associated with a release button 59 which is supported for movement between projected and depressed positions in a direction generally parallel to the longitudinal dimension of the carrying case 51, said release button 59 being normally biased upwards by a spring member 60 to assume the projected position. The release button 59 is partly concealed within the lateral covering 58 and has an engagement tongue that is engageable with one end of the hook member 57 opposite to a hook end thereof, however, said engagement tongue being separated from the end of the hook member 57 because the release button 59** is normally biased to the projected position as hereinabove described.

Figure 9:
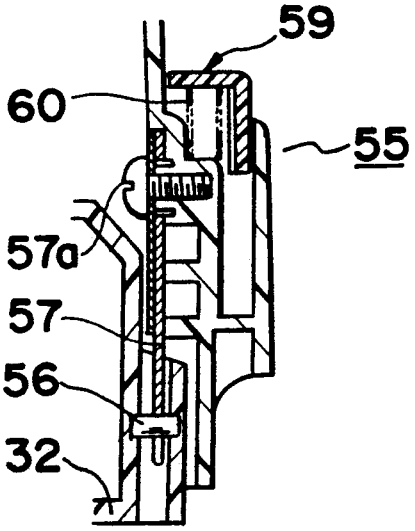
FIG. 9 is a sectional view, on an enlarged scale, showing one of the catches used to lock the casing to the stand forming the bottom of the casing.
Figure 10:
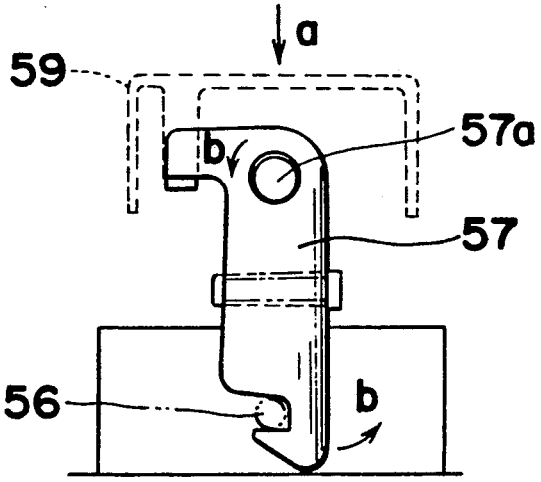
FIG. 10 is a front elevational view of the catch shown in FIG. 9.

FIGS. 9 and 10 illustrate the stand 32 and the carrying case 51 connected together by means of the clamping means 55 with the hook portions of the hook members 57 engaged with the associated engagement pins 56. Starting from this condition, and when the user pushes the release buttons 59 simultaneously towards the depressed position in a downward direction shown by the arrow a in FIG. 10, the hook members 57 are pivoted about the bearing screws **57*a* in a direction shown by the arrow b with the associated hook portions thereof disengaging from the respective engagement pins 56. Subsequent lift of the carrying case 51 away from the stand 32 while the release buttons 59 are kept depressed results in the separation of the carrying case 51 from the stand 32, leaving the iron 21 on the stand 32 exposed to the outside as shown in FIG. 2**.

Where the iron assembly is desired to be covered by the carrying case 51, all that the user should do is to place the carrying case 51 over the iron assembly, specifically the stand 32, and then to push the carrying case 51 downwards until the hook portions of the hook members 57 being pivoted against the springs 60 in contact with the engagement pins 56 catch the respective engagement pins 56.

The iron assembly accommodated in the carrying case 51 can be transported from place to place with the user's hand gripping the handle 53.

The heat insulating plate 54 inside the carrying case 51 may not always be essential in the practice of the present invention, however, the use thereof is particularly advantageous in that the carrying case 51 can be placed over the iron assembly immediately after the use of the iron without requiring the iron to stand for a substantial length of time, thereby to substantially eliminate the risk of a burn which the user or any other person may suffer from when touching the bare iron. Also, since the stand 32 itself serves not only to support the iron 20, but also to form the bottom of the carrying case 51, the iron 21 placed on the stand 32 need not be placed on a extra plate member which would otherwise form the bottom of the carrying case 51.

Although the present invention has been fully described in connection with the preferred embodiment thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A cordless iron assembly which comprises:

a power supply stand having a connecting means for connection with a source of electric power;

an iron removably mounted on the stand and comprising an electric heater and a soleplate adapted to be heated by the heater;

separable electric connecting terminal means interposed between the iron and the stand for establishing an electric connection between the electric heater in the iron and the stand when and so long as the iron is placed on the stand and also for interrupting the electric connection therebetween when the iron is removed from the stand;

iron placement detector means on said stand for detecting the pressure of an iron on the stand and absence of an iron from the stand;

a counting means responsive to the detection of the absence of the iron from the stand by said detector means for counting the length of time during which the iron is removed from the stand and for providing an output signal after a predetermined time;

a warning means; and a control means operable in response to the output signal from the counting means to activate the warning means.

2. The cordless iron assembly as claimed in claim 1, further comprising a temperature detector on said iron for detecting the temperature of the soleplate, and a selectively variable temperature control means for controlling the supply of electric power to the heater in response to the temperature detected by said temperature detector to cause the soleplate to be heated to a predetermined temperature when and so long as the iron is placed on the stand with the electric power supplied thereto, and wherein said counting means includes means for adjusting the length of time which passes before the output signal is generated in dependence on the predetermined temperature set in the temperature control means.

3. The cordless iron assembly as claimed in claim 2, wherein the length of time which passes before the output signal is generated from the counting means and the predetermined temperature set in the temperature control means have a directly proportional relationship with each other.

4. The cordless iron assembly as claimed in claim 2, wherein the relationship between the length of time which passes before the output signal is generated from the counting means and the predetermined temperature set in the temperature control means includes a first region, in which the length of time which passes before the output signal is generated from the counting means and the predetermined temperature set in the temperature control means have a directly proportional relationship with each other, and a second region in which the length of time which passes before the output signal is generated from the counting means and the predetermined temperature set in the temperature control means exhibits an inverse proportion to each other.

5. The cordless iron assembly as claimed in claim 1, wherein at least the counting means, the warning means and the control means are incorporated in the stand.

6. The cordless iron assembly as claimed in claim 1, wherein said connecting means is an electric cord, and the stand has a room for accommodating said electric cord.

7. The cordless iron assembly as claimed in claim 1, wherein the iron has a vaporizing chamber and a water passage defined therein and includes a valve means responsive to the temperature of said soleplate for selectively closing the water passage when the temperature of the soleplate is lower than the temperature at which water can be vaporized and opening the water passage when the temperature of the soleplate is equal to or higher than the temperature at which water can vaporize, respectively.

8. A cordless iron assembly which comprises:

a stand including a terminal means and an electric cord connecting the terminal means to a source of electric power;

an iron having a mating terminal means which is removably electrically connected with the terminal means of the stand when and so long as the iron is placed on the stand; and a carrying case detachably connected to said stand and having a shape for accommodating the iron with the iron in position on the stand with the mating terminal means electrically connected with the terminal means of the stand for the storage of the iron.

9. The cordless iron assembly as claimed in claim 8, further comprising releasable clamping means for detachably connecting the carrying case and the stand together.

* * * * *